US007198538B2

(12) United States Patent
Chin-Cheng

(10) Patent No.: US 7,198,538 B2
(45) **Date of Patent: *Apr. 3, 2007**

(54) INFLATABLE FIGURE ASSEMBLY

(75) Inventor: Tsai Chin-Cheng, Linluo Shiang (TW)

(73) Assignee: Gemmy Industries, Inc., Coppell, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/705,034

(22) Filed: Nov. 10, 2003

(65) Prior Publication Data

US 2004/0180604 A1 Sep. 16, 2004

Related U.S. Application Data

(63) Continuation of application No. 10/042,622, filed on Jan. 9, 2002, now Pat. No. 6,644,843.

(51) Int. Cl.
*A63H 3/06* (2006.01)

(52) U.S. Cl. ..... 446/220; 446/226

(58) Field of Classification Search ..... 446/220–226, 446/176, 178, 179; 326/255, 256, 378, 360, 326/441, 410

See application file for complete search history.

(56) References Cited

U.S. PATENT DOCUMENTS

| | | | | |
|---|---|---|---|---|
| 2,383,390 | A | 8/1945 | Jacobs | |
| 2,513,427 | A * | 7/1950 | Richa et al. | 223/67 |
| 2,593,188 | A | 4/1952 | Rikelman | |
| 3,250,024 | A | 5/1966 | Douthitt et al. | |
| 3,363,350 | A | 1/1968 | Moran | |
| 3,670,160 | A * | 6/1972 | Flowers et al. | 362/378 |
| 3,672,083 | A | 6/1972 | Moran | |
| 3,745,677 | A | 7/1973 | Moran | |
| 3,835,308 | A | 9/1974 | Reese | |
| 4,044,693 | A * | 8/1977 | Ramsey, Jr. | 410/119 |
| 4,141,062 | A * | 2/1979 | Trueblood | 362/400 |
| 4,179,832 | A | 12/1979 | Lemelson | |
| 4,762,298 | A * | 8/1988 | Wood | 248/179.1 |
| 4,791,541 | A * | 12/1988 | Simmons | 362/376 |
| 4,837,958 | A | 6/1989 | Radovich | |
| 4,932,169 | A | 6/1990 | Charbonneau | |
| 4,991,363 | A | 2/1991 | Randmae | |
| 5,125,177 | A * | 6/1992 | Colting | 40/610 |
| 5,186,675 | A * | 2/1993 | D. Stoddard | 446/199 |
| 5,462,505 | A | 10/1995 | Blair et al. | |
| 5,467,543 | A | 11/1995 | Fink et al. | |
| 5,471,797 | A | 12/1995 | Murphy | |
| 5,603,185 | A | 2/1997 | Murphy | |
| 5,632,553 | A * | 5/1997 | Huang | 362/410 |
| 5,683,167 | A * | 11/1997 | Tarlow | 362/96 |
| 5,710,543 | A | 1/1998 | Moore | |

(Continued)

*Primary Examiner*—Eugene Kim
*Assistant Examiner*—Urszula M Cegielnik
(74) *Attorney, Agent, or Firm*—Venable LLP; Stuart I. Smith

(57) ABSTRACT

A displayable inflatable figure has a main hollow body that is of a soft and air-permeable fabric. An extended part at the bottom includes a fan assembly to force air flow into the main body. An internally attached lighting system is fastened to provide illumination without external lighting. When connected with power, the fan continuously pumps air into the body. When air is filled in the body, excessive air leaks out from the fabric so that the figure can keep a good shape.

14 Claims, 4 Drawing Sheets

U.S. PATENT DOCUMENTS 6,148,551 A * 11/2000 Glass ..... 40/214
6,186,857 B1 2/2001 Gazit et al.
6,322,230 B1 11/2001 Medici
6,431,729 B1 * 8/2002 Chen ..... 362/249
6,554,443 B2 * 4/2003 Fan ..... 362/96
6,572,247 B2 * 6/2003 Liu ..... 362/311
6,644,843 B2 * 11/2003 Chin-Cheng ..... 362/97
6,650,246 B2 11/2003 Field et al.
6,764,201 B2 * 7/2004 Chi-Cheng ..... 362/352
6,769,794 B2 * 8/2004 Huang ..... 362/363
2006/0025037 A1 2/2006 Lau

* cited by examiner

INFLATABLE FIGURE ASSEMBLY

CROSS REFERENCE TO RELATED APPLICATION

This application is a continuation of U.S. application Ser. No. 10/042,622, filed Jan. 9, 2002, issued as U.S. 6,644,843 on Nov. 11, 2003.

BACKGROUND OF THE INVENTION

This invention relates generally to air-filled displays and more particularly to an inflatable figure assembly.

The prevailing displayable, inflatable figures use impermeable material such as plastic for the main body. Though this kind of material can be impermeable in a short time period, only a few polyester materials can prevent air from leaking out over a long time period, causing a display to look poor, as the display does not retain its shape. In addition, such air-filled figures are usable in lighted areas or during day light. At night, only with the help of external light, can people notice the existence of the figure.

SUMMARY OF THE INVENTION

An object of the invention is to provide an inflatable figure that persistently contains air inside of the body to retain an improved shape over a desired time period.

Another object of the present invention is to provide an inflatable figure that can be seen with little external light.

In accordance with a preferred embodiment of the present invention, the assembly figure has a hollow body made of soft, permeable fabric, a fan assembly forcing air into the main body, and a lighting system inside of the body. When the air has filled the body, the excessive air leaks out from the fabric, thus the figure can keep a good shape for a long time. In addition, the light inside of the body disperses to the outside, making it visible at nighttime.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
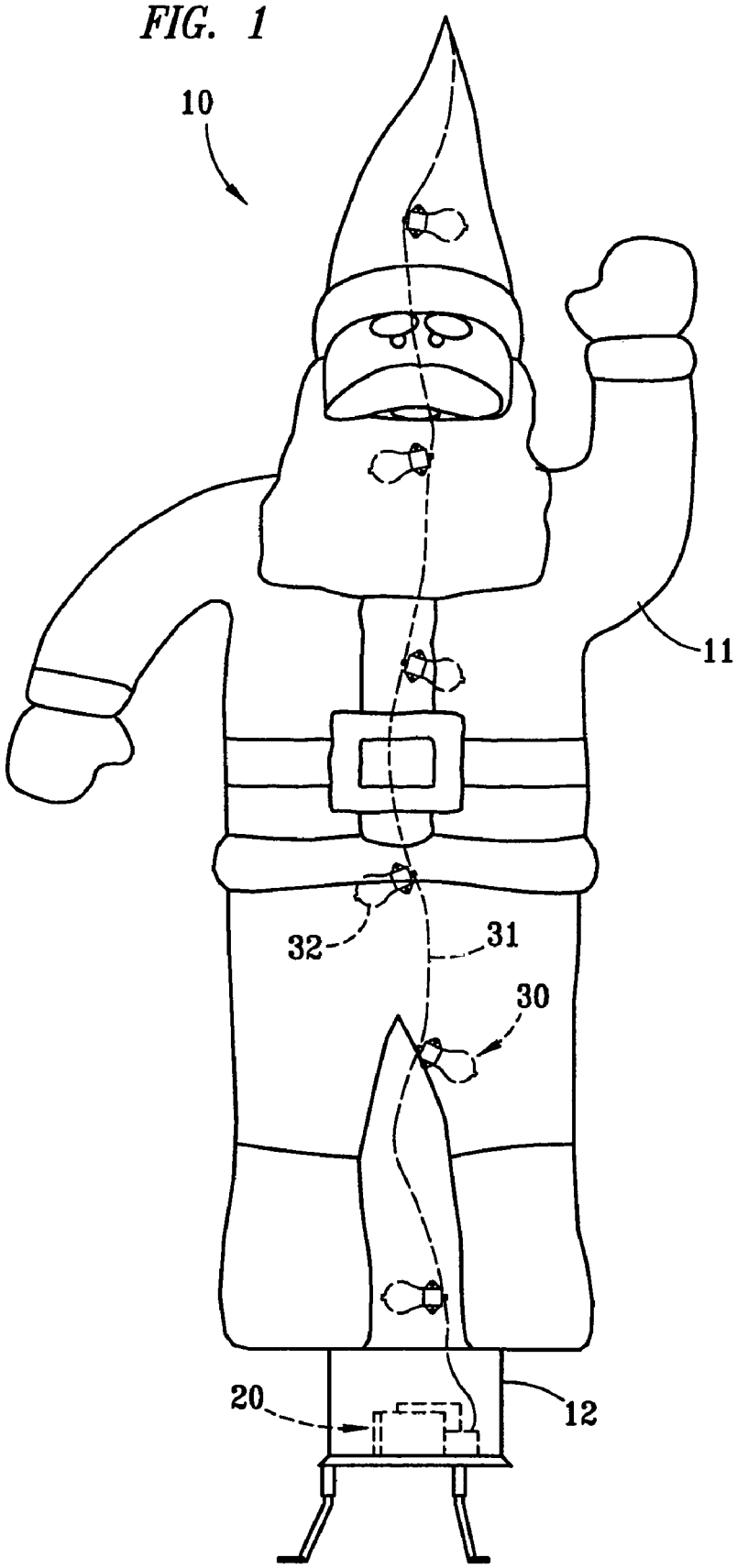
FIG. 1 is a perspective view of the inflatable figure assembly in accordance with a preferred embodiment of the present invention.
Figure 2:
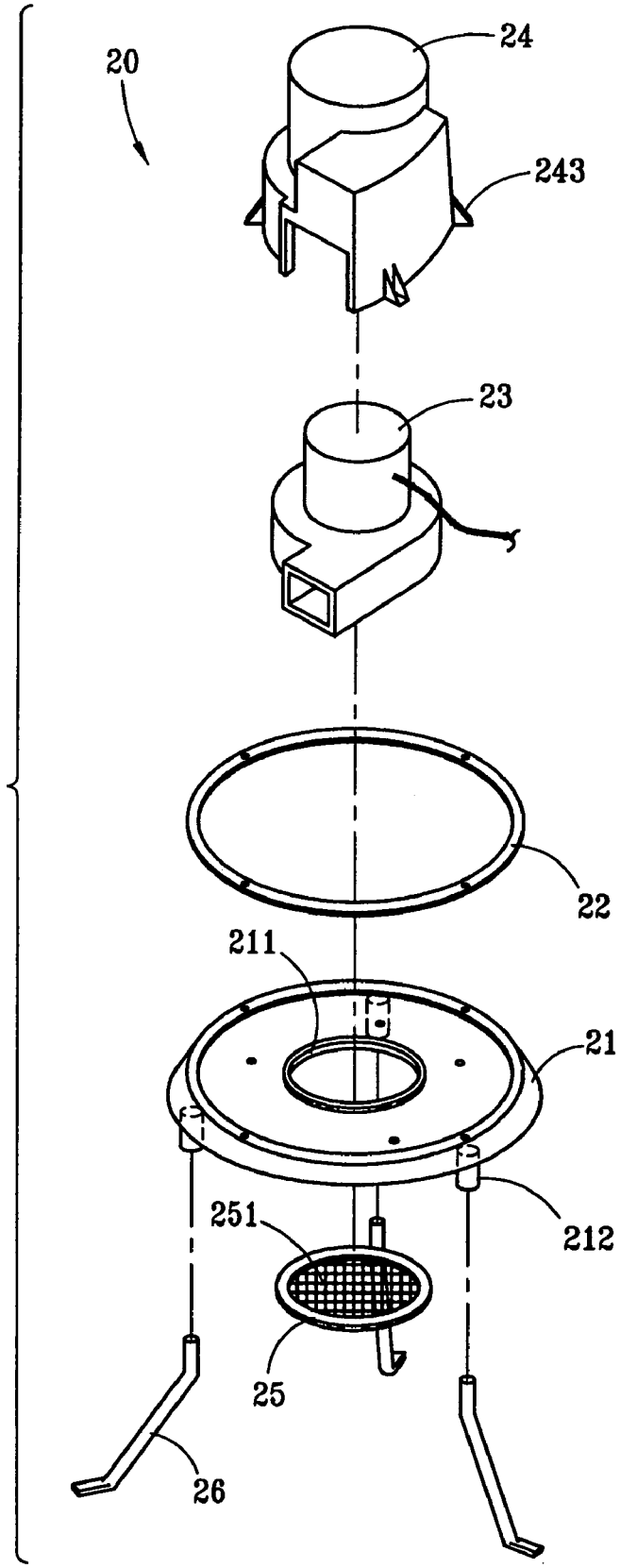
FIG. 2 is an exploded view of the fan and stand assembly in accordance with a preferred embodiment of the present invention.
Figure 3:
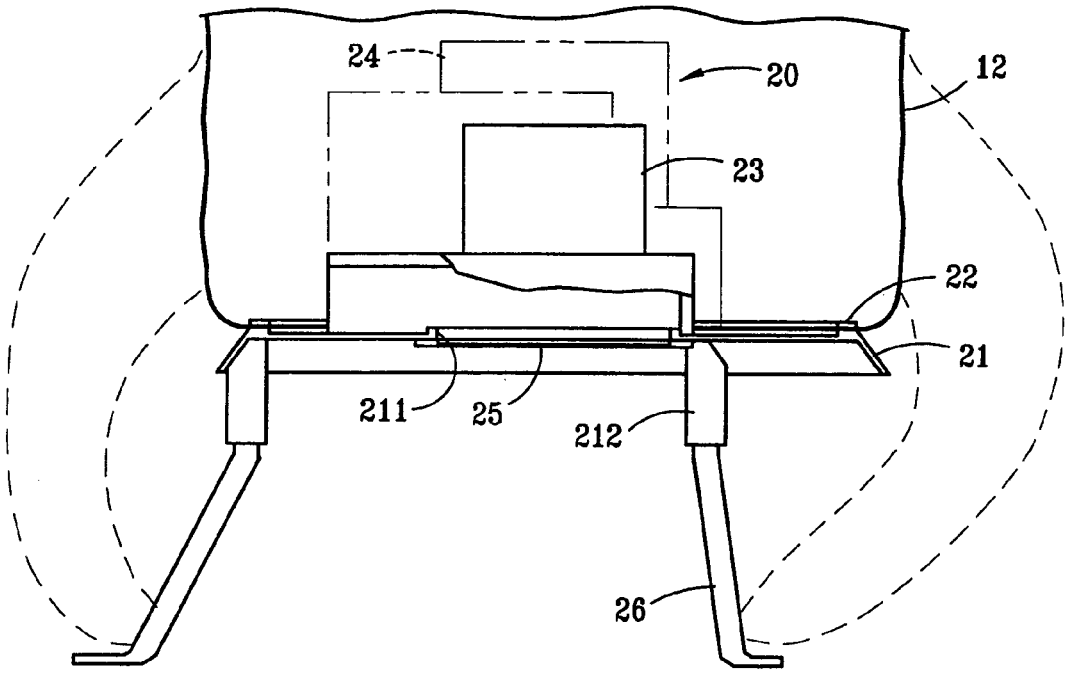
FIG. 3 is a side view of the fan and stand assembly of FIG. 2.

Referring to FIG. 1, inflatable FIG. 10 has hollow main body 11. Main body 11 is made of soft, permeable fabric such as nylon. Extended part 12 at the bottom of main body 11 includes assembly 20. There is also shown lighting system 30 inside of main body 11;

Referring to FIGS. 2 and 3, fan assembly 20 has base 21 and fastening ring 22 having a hole 211. Around base 21, there are several protruding fastening pieces 212 for detachably receiving supporting legs 26. In addition, base 21 and fastening ring 22 help tighten and hold extended part 12. At the bottom of hole 211 of base 21, air vent 25 has a plurality of parallel holes 251 along the edge. Motor 23 is installed on top of base 21, within cover 24. Fastening piece 243 on cover 24 helps to fasten motor 23 on base 21. The motor will continue to force air into the figure when on. Once filled, the permeability of the main body material allows air to escape, while still maintaining the figure shape.

Figure 4:
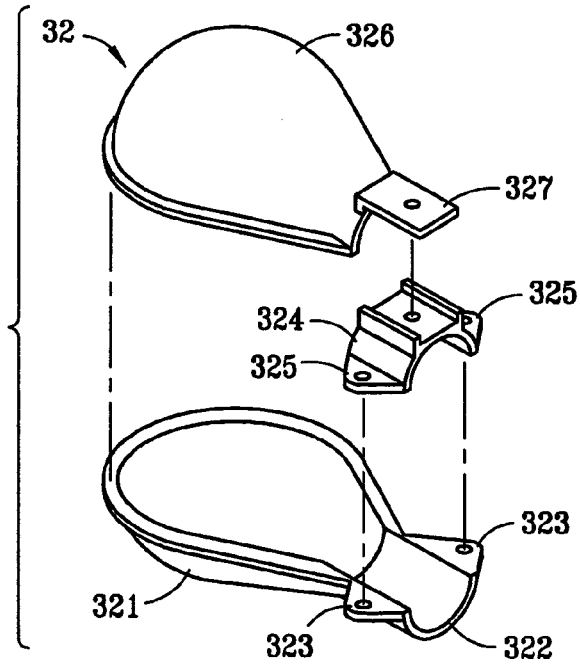
FIG. 4 is an exploded view of a section of the lighting assembly in accordance with a preferred embodiment of the present invention.

Turning to FIGS. 1 and 4, lighting system 30 includes a power cord 31, on which there are several lighting bodies 32. Each lighting body 32 includes a bulb (not shown) and may further include a lower cover 321 and an upper cover 326 to cover the bulb. A connecting base 322 on the lower cover 321 enables the bulbs on the power cord 31 to be inserted into the lower cover 321. A fastening base 324 sets on top of the connecting base 322, and two fastening pieces 323, 325 use screws to fasten them together. Upper cover 326 corresponds to fastening base 324 on which a connecting joint 327 can be set so that the upper and lower covers 326, 321 of the lighting body 32 can cover the bulb inside. The lighting bodies 32 may be strung together as shown or extended at appropriate places within the body 11 of the FIG. 10. When powered, the lighting bodies 32 will illuminate the FIG. 10 from within.

Figure 5:
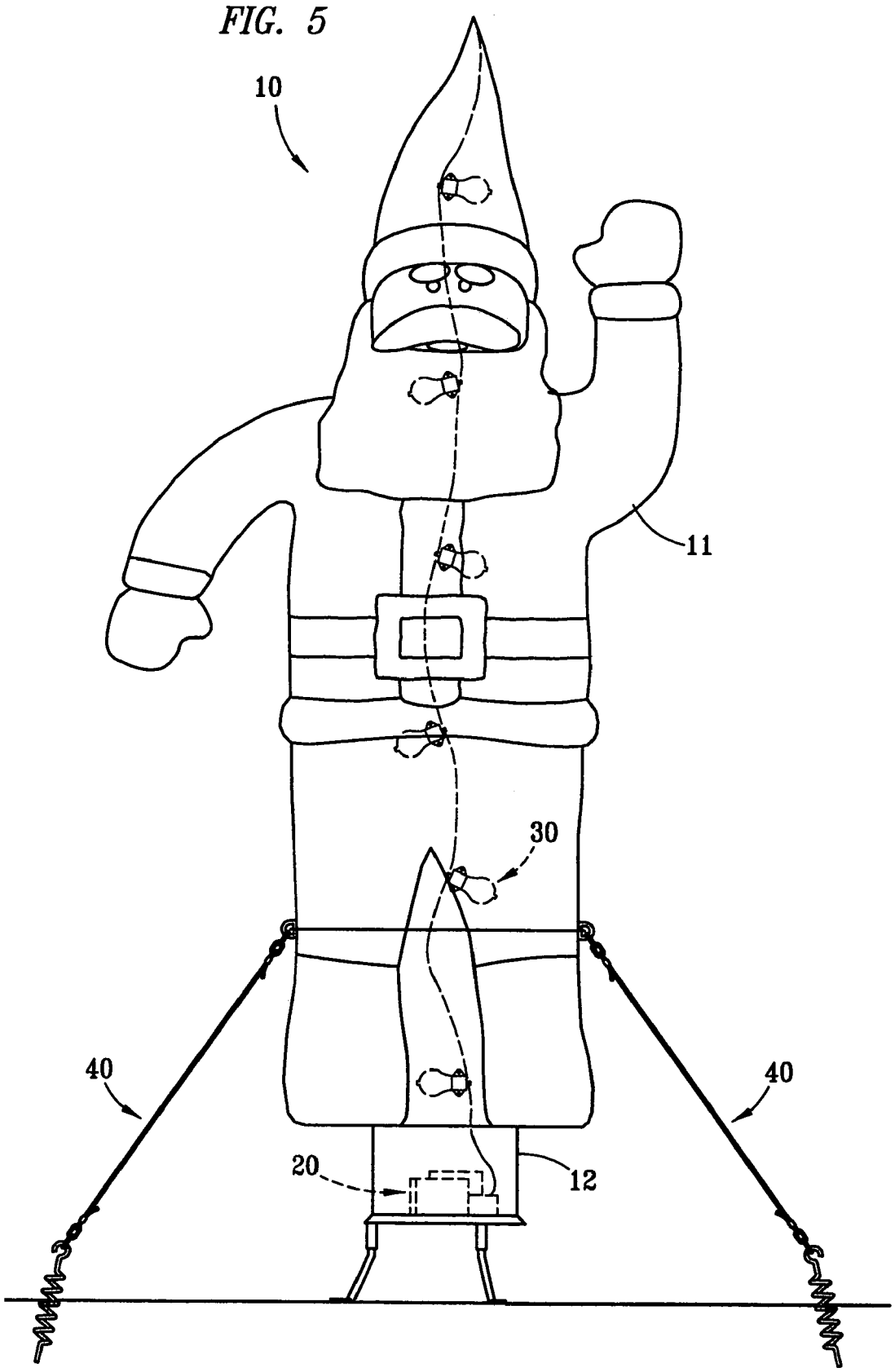
FIG. 5 is a perspective view of the inflatable figure assembly in its fully inflated and tied-down configuration.

Referring to FIG. 5, to set up, body 11 may use supporting legs 212 on fan equipment 20 to stand on the ground. There is a designed space between the ground and base 21 for air circulation for motor 230. If a higher position is needed, the supporting leg on the base could be extended. String may be fastened via loops of material to body 11 to tie down the body. Body 11 may also be designed with additional material towards the lower end that may be connected to the stand so as to cover the stand and fan assembly from view as shown in the dotted lines of FIG. 5.

Though shown here in only one configuration, the main body 11 may take on any of a variety of shapes and sizes. While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An inflatable figure assembly, comprising:

a hollow main body, wherein said hollow main body is made of soft permeable fabric and forms a figure when inflated;

a fan and stand assembly having a base, a fan system attachable to the base, an air passage for channeling air through the base and into the fan system and then into the hollow main body above the base, and a fastening device attaching a portion of the hollow main body to the base; and a lighting system supported inside the inflated hollow main body, the lighting system comprising a power cord and at least one lighting body that illuminates the figure from within, wherein the hollow main body allows air to diffuse through it at a rate no faster than the fan system discharges air into the hollow main body.

2. The inflatable figure assembly of claim 1, wherein the at least one lighting body further comprises a bulb connected to a power cord.

3. The inflatable figure assembly of claim 1, wherein the at least one lighting body comprises a bulb and a cover.

4. The inflatable figure assembly of claim 1, further comprising tie-down rings secured to said hollow main body.

5. The inflatable figure assembly of claim 4, comprising an anchor attachable to each tie-down ring.

6. The inflatable figure assembly of claim 1, wherein the at least one lighting body is a plurality of lighting bodies.

7. The inflatable figure assembly of claim 6, wherein each of the plurality of lighting bodies further comprises a bulb connected to a power cord.

8. The inflatable figure assembly of claim 7, wherein each of the plurality of lighting bodies comprises the bulb and a cover.

9. The inflatable figure assembly of claim 1, wherein the fan system discharges the air directly into the hollow main body.

10. The inflatable figure assembly of claim 1, wherein the fan system is located inside the base.

11. The inflatable figure assembly of claim 10, further comprising a hole in the base, wherein the air is received through the hole.

12. The inflatable figure assembly of claim 11, wherein the hole is in a bottom of the base and the air is received upwardly through the hole.

13. The inflatable figure assembly of claim 1, further comprising a hole in the base, wherein the air is received through the hole.

14. The inflatable figure assembly of claim 13, wherein the hole is in a bottom of the base and the air is received upwardly through the hole.

* * * * *